United States Patent [19]

Ellison et al.

[11] 4,136,636

[45] Jan. 30, 1979

[54] SOLVENT VAPOR COLLECTOR

[75] Inventors: Kenneth Ellison, Markham; Alan S. Whike, R.R. #1, Caledon East, both of Ontario, Canada

[73] Assignee: B & K Machinery International Ltd., Toronto, Canada

[21] Appl. No.: 836,522

[22] Filed: Sep. 26, 1977

[51] Int. Cl.[2] ..... B05C 15/00

[52] U.S. Cl. ..... 118/68; 34/155

[58] Field of Search ..... 118/65, 68, 61; 101/416 A; 34/155, 156; 15/315, 301

[56] References Cited

U.S. PATENT DOCUMENTS

| | | | |
|---|---|---|---|
| 2,060,430 | 11/1936 | Spooner | 118/68 X |
| 3,183,605 | 5/1965 | Argue et al. | 118/68 X |
| 3,592,160 | 7/1971 | Schwieterman et al. | 118/65 |
| 3,744,963 | 7/1973 | Flynn | 34/155 X |

*Primary Examiner*—John McIntosh

*Attorney, Agent, or Firm*—Rolston, George A.

[57] ABSTRACT

A solvent vapor collector is mounted on the upstream inlet end of an oven having a gas-circulating means and intended for curing a coating applied to a strip sheet metal at a coating station. The strip sheet metal may be hot and solvent vapors are evaporated at the coating station and from the strip as it passes from the coating station to the oven. Upper and lower plenums within a housing of the collector are supplied with oven gases or air from the gas-circulating means and such gases or air are discharged within the collector obliquely in a downstream direction against the strip passing through that collector to establish downstream gas flows along the top and under surfaces of the strip so as, in turn, to induct solvent vapors into the collector at the coating station. A telescopic multi-piece shroud is usefully provided on the housing for movement between an extended position in which it overlies the coating station to collect solvent vapors released thereat and a retracted position permitting ready cleaning and adjustment of that coating station.

14 Claims, 5 Drawing Figures

SOLVENT VAPOR COLLECTOR

BACKGROUND OF THE INVENTION

The present invention relates generally to a solvent vapour collector for use in conjunction with an oven for curing coatings containing vapourizable solvents as applied to strip sheet and especially strip sheet metal.

In such known coating/curing plants, the coating is applied to the strip sheet metal at a coating station, for example, by passage between coating rollers. From the coating station, the coated strip passes to the curing oven in which the coating is dried or cured with the vaporization of the solvent from the coating.

Most such solvents are hazardous and must be eliminated before oven gases are exhausted into the atmosphere. Additionally, many such solvents are oxidizable and can be oxidized either by incineration or catalytic oxidation to provide heat which can be utilized in the curing oven so reducing the amount of primary fuel required for oven operation.

Considerable attention has already been given to the treatment of the solvent vapours released in the oven and many systems have heretofore been proposed for incinerating such oven solvent fumes. However, some solvent fumes are released into the coating room atmosphere and so escape treatment; their heat values are lost and they present an environmental and occupational hazard.

It will be appreciated that solvent vapours will inevitably escape not only from the coating station itself but also from the coated strip during its passage from the coating station to the oven inlet. Such escape of solvent vapours into the coating room atmosphere is especially severe when the strip entering the coating station is at an elevated temperature as is the case, for example, when a finish coat is being applied to a strip which has already been coated with a prime coating, such as a rust-proofing coating, and cured and is still at an elevated temperature. In such a coating station, the primed strip entering that coating station may still be at a temperature as high as 200° to 250° F. and consequently coating solvent will be vaporized rapidly and in relatively large amounts at the coating station and between that station and the oven inlet.

Quenching to a lower temperature would assist in solving this problem but many prime coatings are water based and it is not possible, therefore, to cool the strip by water quenching, air quenching below too slow to be effective.

In a situation of the type described, it is necessary and, in most jurisdictions, mandatory to extract such solvent fumes from the coater room in order to eliminate the health hazard and to avoid the risk of explosion concomitant with the existence of high solvent vapour levels.

While it is possible to provide a separate ventilation system for extracting such solvent fumes from the coater room, the provision of such a system would be relatively expensive. In many existing operations, the existing coater room ventilation systems would not have adequate capacity for handling the extra quantities of solvent vapours involved in an operation of the type hereinbefore mentioned and, in such a case, the replacement or supplementation of such an existing ventilating system would also involve considerable cost.

In existing operations where a tandem system is employed with the application and curing first of a priming coat and the subsequent application and curing of a finish coat, the problem of solvent evaporation at the finish coating station and between that coating station and the finish coat oven places limits on the actual line speed for the entire operation.

Accordingly, it is a principal object of this invention to provide a solvent vapour collector for use in conjunction with a coating-curing system of the type in question and with which solvent vapours released at a coating station and between such a coating station and an oven inlet can be collected and then mixed with the oven gases for treatment and recovery of heat values and also thereby ensuring adequate ventilation of the coater room.

It is a further object of this invention to provide a solvent vapour collector which permits the operating line speed of many existing coating-curing systems to be increased while avoiding the potential hazards which would otherwise result from the escape of increased volumes of solvent vapours.

Another object of this invention is to provide a solvent vapour collector which is relatively simple but versatile in its construction and which is, therefore, relatively inexpensive to construct and install.

Other objects of the invention will become apparent as the description herein proceeds.

SUMMARY OF THE INVENTION

In accordance with one feature of this invention, there is provided a solvent vapour collector for use on the upstream end of a strip sheet coating-curing oven having an oven gas circulating means and which collector comprises a housing having a base, a roof and side walls, adapted, about its downstream end, to be secured to an upstream inlet end of such an oven and provided, at its upstream end, with an upstream opening for the passage into said housing of both a coated strip sheet and solvent vapours; an upper plenum disposed within said housing and having openings for discharge of gases from within said upper plenum against the top surface of such a strip sheet passing through said housing; a lower plenum disposed within said housing and having openings for the discharge of gases from within said lower plenum against the undersurface of such a strip sheet passing through said housing; and gas supply means for the supply of gases to both said upper plenum and said lower plenum for discharge through said openings therein so as to induct gas flows in a downstream direction along the top and under surfaces of such a strip sheet passing through said housing and thereby in turn, inducting the air and solvent vapours into said housing through said upstream opening thereof.

This invention also embraces the combination of a solvent vapour collector as hereinbefore defined with an oven having an inlet opening and provided with a gas-circulating means which is operative to establish a negative pressure at such oven inlet opening. In such a combination, the gas-circulating means can be utilized to provide the required gas flow to the solvent vapour collector so avoiding the need for separate gas-circulating fans or blowers in that collector itself.

In accordance with another feature of this invention, the aforementioned openings in the upper and lower plenums of a solvent vapour collector are usefully disposed so as to discharge gases in an oblique direction against a strip sheet passing therebetween thereby serving further to induct the desired downstream gas flows along the top and under surfaces of such a strip sheet.

In accordance with a further feature of this invention, there is provided a solvent vapour collector for use on the upstream end of a strip sheet coating-curing oven and which comprises: a housing having a base, a roof, side walls and an upstream end wall and adapted about its downstream end to be secured to an upstream inlet end of such a curing oven; an elongated shroud movably mounted in said upstream end wall of said housing for movement between a retracted position in which said shroud is disposed at least partially within said housing and an extended position in which said shroud projects in an upstream direction from said housing, said shroud being defined by at least a roof and side walls and having an opening for the passage into said shroud of both a coated strip sheet and also solvent vapour from the coating; and co-operating guide means on said housing and said shroud permitting movement of said shroud between said retracted and extended positions thereof.

The elongated shroud provided in such a collector is usefully provided generally at its upstream end with an open undersurface for overlying the coating station whereby solvent fumes escaping from that coating station may be inducted into such shroud for passage through the collector housing and into the oven.

In accordance with another useful but optional feature of this invention, the elongated shroud of such a collector comprises a plurality of generally tubular elongated members mutually telescopic and extensible from and retractable into said housing.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

The invention will now be described merely by way of illustration with reference to the accompanying drawings, in which.

DESCRIPTION OF THE PREFERRED EMBODIMENT

In the accompanying drawings, the legend 10 generally indicates a coating station at which a coating is applied to an elongated workpiece S such as strip sheet metal. Such a coating will contain a vaporizable solvent which is evaporated from the strip S in a curing or drying oven shown fragmentarily and generally at 12.

Figure 1:
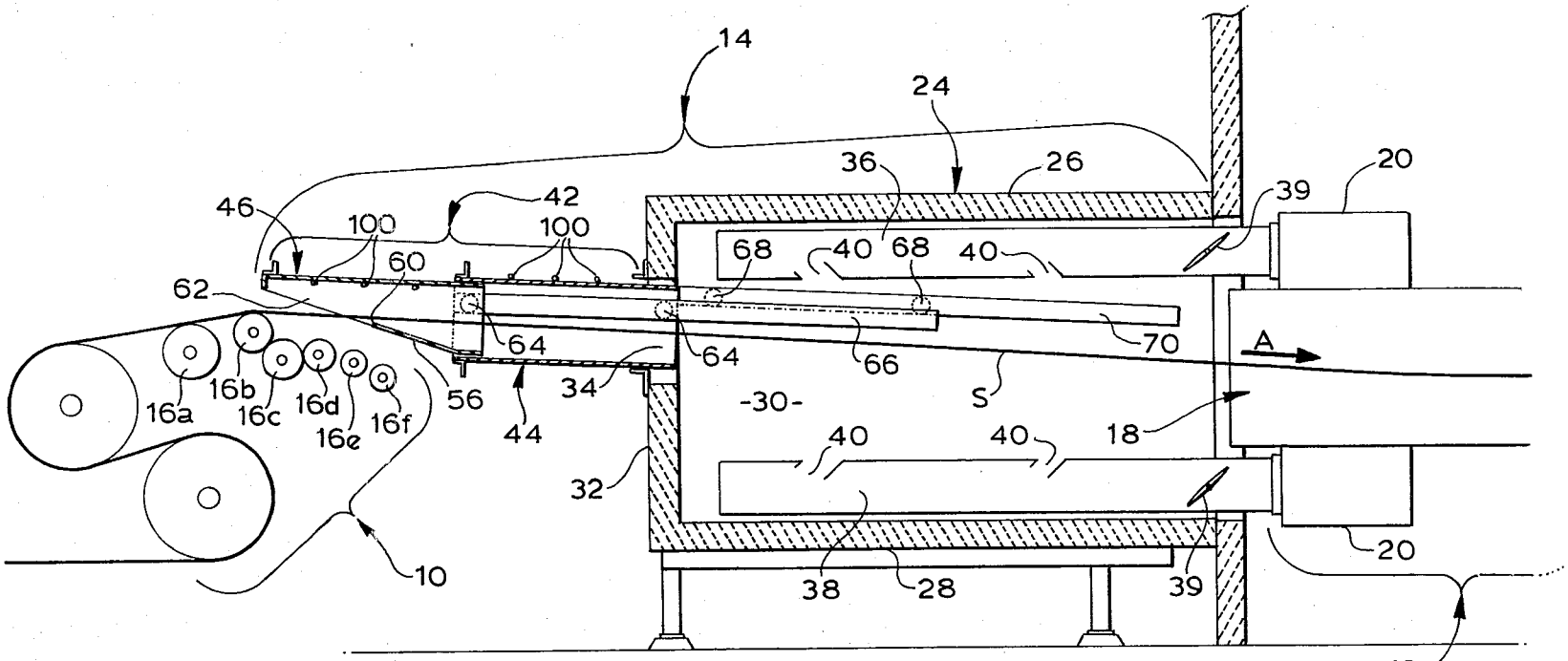
FIG. 1 is a somewhat simplified longitudinal sectional view through one embodiment of a solvent vapour collector in accordance with this invention showing such collector positioned between a strip sheet metal coating station and an oven, with a shroud forming part of such a collector being shown in an extended position thereof.
Figure 2:
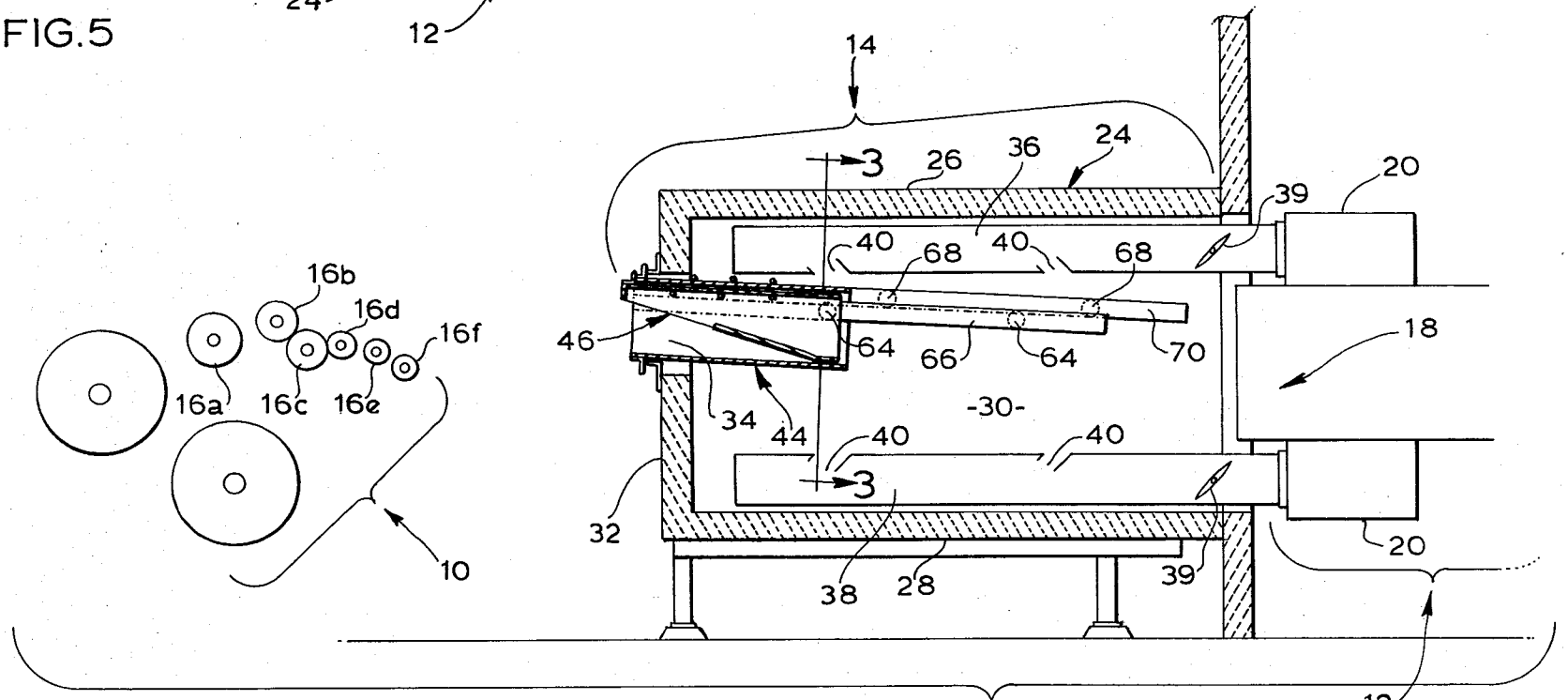
FIG. 2 is a somewhat simplified longitudinal sectional view similar to that of FIG. 1 but showing the shroud in a retracted position thereof and with the strip sheet omitted.

In accordance with this invention, there is provided between the coating station 10 and the oven 12 a solvent vapour collector generally indicated by the legend 14. Since the structures of the coating station 10 and the oven 12 are only secondary to this invention, they will not be described in detail herein. It will merely be mentioned that the coating station 10 comprises a plurality of rollers **16*a*, 16*b*, 16*c*, 16*d*, 16*e* and 16*f* by means of which a coating is applied to the strip S. It should perhaps also be indicated that the oven 12 is shown in FIGS. 1 and 2 as being provided at its upstream inlet end 18 with an air curtain in a conventional manner and by means of which air or recycled oven gases are circulated above and below the strip sheet S as it enters the oven 12. As is conventional such an air curtain provides a slightly negative pressure at the oven inlet end 18 so as to prevent the escape of solvent fumes out of such upstream end of the oven. For this purpose, the oven 12 is shown in FIGS. 1 and 2 as being provided with a plenum 20 for circulating air or other gases in such an air curtain. It will, of course, be understood that suitable fans or blowers will be provided for maintaining such gas flow. One typical arrangement will be described in greater detail hereinafter with reference to the system shown in FIG. 4** of the accompanying drawings.

In accordance with one important feature of the present invention, the solvent vapour collector 14 comprises a housing generally indicated at 24 (omitted from FIGS. 3 and 4) and which in turn comprises a roof 26, a base 28, side walls 30 and an upstream end wall 32. At its downstream end, the housing 24 is secured to the upstream end of the oven 12 in any suitable gas-tight manner. An opening 34 is provided in the upstream end wall 32 of the housing 24 to permit entry of the strip S from the coating station 10 into that housing 24.

Within the housing 24, there are provided an upper plenum 36 and a lower plenum 38 which are provided in their opposed faces with openings 40 for the discharge of gases therefrom against the coated workpiece or strip sheet S passing therebetween.

Plenums 36 and 38 are preferably dimensioned so as to have widths at least equal to the width of the widest strip that can be coated at the coating station 10 and cured in the oven 12.

In the particular embodiment shown in FIGS. 1 and 2, the upper plenum 36 and the lower plenum 38 are shown as receiving gases from the oven plenum 20. Dampers 39 are provided for controlling gas flow into the plenums 36 and 38.

In accordance with a particularly advantageous feature of this invention, the openings 40 for the discharge of gases against the strip S are disposed obliquely so as to induct downstream gas flows along the top and under surfaces of such a strip as will best be understood and will later be explained by reference to FIG. 4 of the accompanying drawings. It will also be understood that the establishment of such downstream gas flows will be assisted by the negative pressure existing at the oven inlet end 18.

In accordance with another especially useful feature of this invention, the solvent vapour collector 14 comprises an extensible/retractable shroud which is generally indicated by the legend 42 and which is suitably mounted on the housing 24 so that, when such shroud 42 is in its extended position as shown in FIG. 1, it projects in the upstream direction from the upstream end wall 32 of the housing 24 generally to the coating station 10.

In the embodiment shown in the accompanying drawings, the shroud 42 comprises a downstream section generally indicated at 44 and an upstream section generally indicated at 46, which sections are mutually telescopic for movement between the extended position shown in FIG. 1 and the retracted position shown in FIG. 2.

Figure 3:
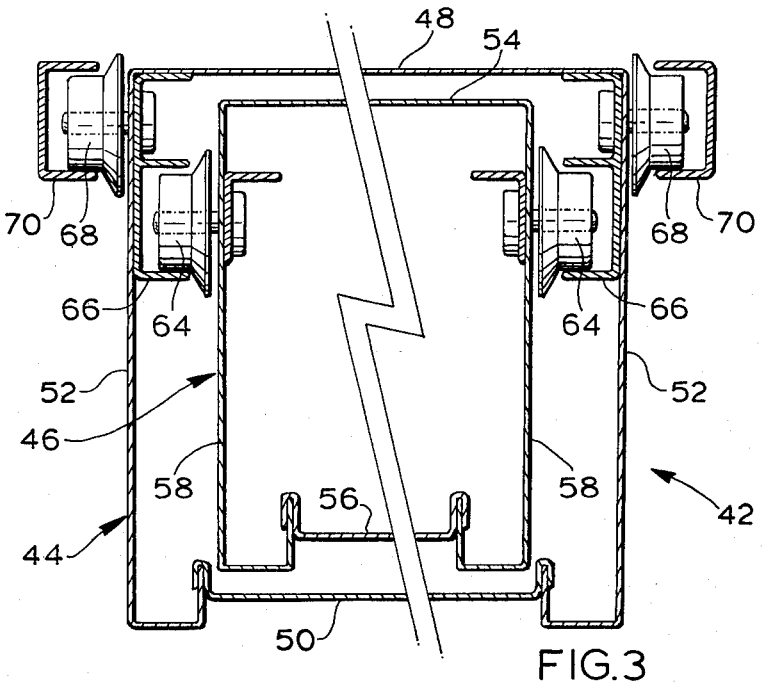
FIG. 3 is a fragmentary transverse section through the shroud of the solvent vapour collector shown in FIGS. 1 and 2 when taken as indicated by the arrows 3—3 of FIG. 2.

As shown in FIG. 3, the downstream section 44 of the shroud 42 is in the form of an elongated generally tubular member having a roof 48, a base 50 and side walls 52 while the upstream section 46 is in the form of an elongated, generally tubular member having a roof 54, a partial base 56 and side walls 58.

The base 56 of the upstream section 46 of the shroud 42 terminates in an upstream edge 60 which is disposed downstream relative to the upstream edges of the roof 54 and side walls 58 of that upstream section 46, so providing a downwardly directed opening 62 generally overlying the rollers **16*a* to 16*f* of the coating station 10**.

While the upstream and downstream sections 46 and 44 respectively of the shroud 42 are shown in FIG. 3 as having a folded sheet metal construction, it will, of course, be understood that other forms of construction are equally possible.

As a result of the downstream gas flow existing within the housing 24 as already mentioned herein, a similarly downstream gas flow is established within the shroud 42. Consequently, solvent vapours escaping from the strip S during its passage through the coating station 10 as well as such vapours escaping from that station 10 itself are upwardly inducted through the opening 62 in the upstream section 46 of the shroud 42 and such vapours then flow through that shroud 42 and through the housing 24 into the oven 12, so very significantly reducing the undesirable release of such fumes into the coater room and so drastically reducing the need for ventilation of that room to maintain non-hazardous working conditions.

When it is necessary to service or adjust the coating system at the coating station 10, ready access to that system is permitted by the retractability of the shroud 42 which is shown in FIG. 2 in its retracted position.

While this invention is in no way restricted to the use of any particular mechanism for allowing extension and retraction, as required, of the shroud 42, the upstream section 46 of that shroud 42 is shown in FIGS. 1 to 3 as being provided on each of its side walls 58 with roller 64 which can move along tracks 66 secured to the inner faces of the side walls 52 of the downstream section 44 of the shroud 42.

Similarly, rollers 68 are mounted on the outer surfaces of the side walls 52 of the downstream section 44 of the shroud 42 for movement along tracks 70 suitably supported within the housing 24.

Locking means (not shown) may be provided, if required, for holding the sections 44 and 46 of the shroud 42 in their extended positions.

Figure 4:
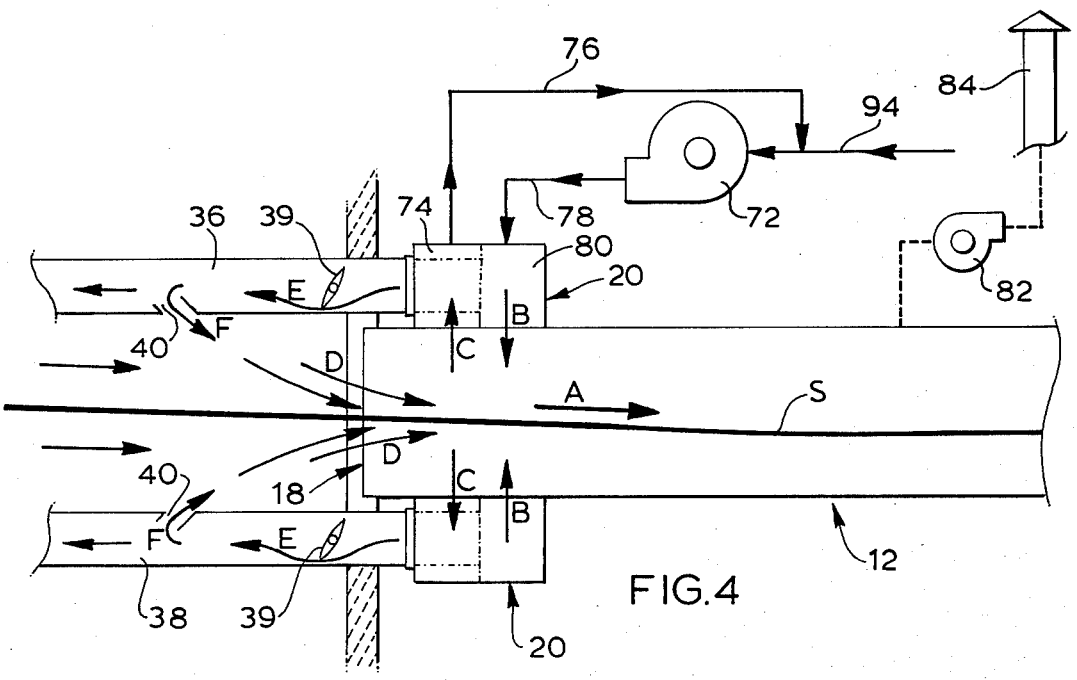
FIG. 4 is a somewhat schematic and fragmentary diagram showing a typical gas flow system usefully adopted in accordance with the teachings of this invention.

Reference will next be made to FIG. 4 of the accompanying drawings which shows on typical but non-restrictive arrangement for ensuring the desired gas flow within a solvent vapour collector in accordance with the present invention.

In the arrangement shown in FIG. 4, a fan or blower 72 is provided for circulating gases about the strip S as it passes through the upstream inlet end 18 of the oven 12. Gases are extracted by the fan 72 through an extraction plenum 74 and ducting 76 and are recirculated through ducting 78 to a supply plenum 80.

A slightly negative pressure is established at the oven inlet 18 by an oven exhaust fan 82 which discharges oven gases to a stack 84. Such negative pressure inducts the inward flow of gases from the housing 24 of the solvent vapour collector 14 through the oven inlet 18. If desired, oven gases, possibly after incineration, may be recycled to the fan 72 through ducting 94.

Having completed the description herein of the structure of the solvent vapour collector 14 as shown in the accompanying drawings and of the manner in which such collector is provided between a coating station and a coating-curing oven, the description herein will now proceed with a brief summary of the manner of operation of the system as so described.

Having made any necessary adjustments at the coating station 10, the operator moves the sections 44 and 46 of the shroud 42 into their extended positions as shown in FIG. 1 and locks those sections in such extended positions using any appropriate locking means (not shown).

On operation of the coating station 10 and of the oven 12 with movement of the strip S in the direction of the arrow A and operation of the various oven fans, including the fans 72 and 82, hot gas circulation as indicated by the arrows B and C is established at the oven inlet 18. As already indicated, the gas circulation system is designed to provide a slightly negative pressure at the oven inlet 18 and such negative pressure causes an inward gas flow into the oven as indicated by the arrows D. Since essentially gas-tight connections are provided between the housing 24 and the oven 12, between the downstream shroud section 44 and the housing upstream wall 32 and between the shroud sections 44 and 46, the negative pressure at the oven inlet 18 causes the establishment of a downstream flow of gases above and below the strip S throughout both the shroud and the housing 24.

During such operation, hot gases also pass from the oven supply plenum 80 into the upper and lower plenums 36 and 38 respectively in the housing 24 as indicated by the arrows E, such gas flows being controlled by adjustment of the dampers 39. From the plenums 36 and 38, such diverted gases are discharged obliquely in a downstream direction against the top and under surfaces of the strip S as indicated by the arrows F, so further establishing the downstream gas flows in the housing 24 and further ensuring the induction of solvent vapours into the upstream end of the shroud 42.

By the provision of the system as hereinbefore described, the amount of solvent vapour released into the coater room is very significantly reduced so correspondingly reducing the necessity for ventilating the coater room. Additionally, since such vapours are inducted into the oven gas circulation system, additional heat may be recovered by the oxidation of such solvent vapours in oven incinerators (not shown), so in turn leading to decreased consumption of primary fuel.

It will be understood that the oven gases entering the plenums 36 and 38 will normally be at an elevated temperature, generally within the range of from about 300° F. to about 600° F. Such oven gases will heat the plenums so preventing the condensation of solvent vapours within the housing 24, which condensation might otherwise cause serious problems.

In order to eliminate the risk of condensation of such solvent vapours on the metal surfaces of the shroud 42, auxiliary electric heating elements 100 may be provided on the sections 44 and 46 of the shroud as shown in FIG. 1 but not shown in the other figures of the accompanying drawings.

Another important advantage of this invention results from the fact that the coated strip S effectively enters the oven system at a position which is much nearer the coating station 10 than is conventional. In most coating-curing systems of the type described, the coated strip hangs in a catenary curve between the rollers **16*b* at the coating station and an exit roller (not shown) at the downstream end of the oven 12. During operation of the system with movement therethrough of the strip S, there is some variation in the length of strip between such two rollers with the result that the vertical position of the strip S also varies throughout the system. It will be understood that such vertical movement will be nil at the roller 16*b* and will be less at the inlet opening 62 of the shroud 42 than at the inlet opening 18 of the oven 12. Consequently, the vertical extent of the shroud opening 62 can be less than that required for the oven inlet with the result that the rate of cold air flow into the oven 12 can be reduced by the use of a solvent vapour collector in accordance with this invention. As a result of such reduction in such cold air inflow, the primary fuel requirement for heating the oven 12** can also be reduced.

In general, the selection of a suitable size for the shroud opening 62 will be determined so as to ensure adequate solvent vapour collection at the coating station 10 while minimizing the primary fuel demand for heating cold air inducted into the collector 14.

It should also be understood, that after the coating has been applied to the strip S at the coating station 10, such applied coating requires some time to flow into a uniform layer on the strip before that coating strip is subjected to curing conditions in the oven 12. Otherwise, a cured coating of non-uniform thickness would be obtained. It is also known that the time required for such a coating to flow into a sufficiently uniform layer is generally less the higher the temperature. When the strip S entering the coating station 10 is at an elevated temperature as is the case, for example, when a finish coat is being applied at the station to a strip which has already been coated with a prime coating and is still hot from curing in an oven disposed upstream of that coating station, a shorter dwell time is required between the coating station 10 and the oven inlet 18. While such a shorter dwell time could be obtained by increasing the strip speed, this has not been possible in many existing systems since it would result in the evaporation of excessive quantities of solvent into the coater room atmosphere with the resulting increased risks of explosion and of presenting a greater health hazard to personnel working in that room. By the use of a solvent vapour collector in accordance with this invention with its removal and collection of solvent vapours from the coating station 10 and from the strip S during its passage from that station to the oven inlet 18, the speed of the strip S can be increased then being governed only by the maximum operating speed of the coating station 10 and the ability of the oven 12 to cure the coating properly, ventilation of solvent vapours from the coating room no longer being the limiting factor. Consequently, higher efficiency and lower operating costs are possible.

Figure 5:
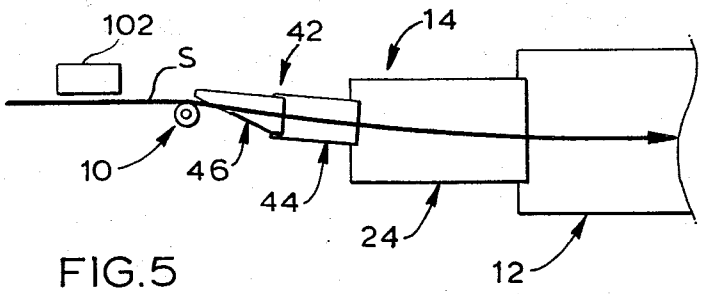
FIG. 5 is a schematic diagram showing the provision of a preheater upstream of the coating station as made possible by this invention.

By reducing the extent of solvent evaporation into the coater room atmosphere, this invention, in fact, makes it practical to provide a strip heating unit 102 as shown schematically in FIG. 5 upstream of the coating station 10 to permit higher strip speeds when coating a strip which has not previously been heated, for example, when a prime coating is being applied to an uncoated strip fed from an uncoiler (not shown) located upstream of heater 102.

The invention therefore makes it possible to increase the strip speed both in a dual coating oven plant and even in a single coating plant.

While the invention has hereinbefore been specifically described with reference to the particular embodiments thereof as shown in the accompanying drawings, it should be understood that numerous variations in and modifications of the described structures are possible without departing from the scope of this invention.

The foregoing is a description of a preferred embodiment of the invention which is given here by way of example only. The invention is not to be taken as limited to any of the specific features described but comprehends all such variations thereof as come within the scope of the appended claims.

What is claimed is:

1. A solvent vapour collector for use on the upstream end of a strip sheet coating-curing oven, said oven receiving strip sheet material carrying a coating containing vapourizable solvents, said coating being applied at a coating station located upstream of said oven, said solvent vapour collector comprising;

a housing having a base, a roof, side walls and an upstream end wall and adapted about its downstream end to be secured to an upstream inlet end of such a curing oven;

an elongated shroud movably mounted in said upstream end wall of said housing for movement between a retracted position in which said shroud is disposed at least partially within said housing and an extended position in which said shroud projects in an upstream direction from said housing towards said coating station, said shroud being defined by at least a roof and side walls and having an opening for the passage into said shroud of both solvent vapours and a coated strip sheet for passage to such an oven, said opening being open to atmosphere at all times;

co-operating guide means on said housing and said shroud permitting movement of said shroud between said retracted and extended positions thereof;

air induction means in said housing for inducting ambient air through said opening and said shroud into said oven, thereby entraining solvent vapours therewith, and, shroud heating means along the roof of said shroud for heating same thereby preventing condensation of solvent vapours thereon.

2. A solvent vapour collector as claimed in claim 1 and in which said shroud is provided generally at its upstream end with an open undersurface for overlying a coating station whereby solvent fumes from such a coating station may enter such shroud for passage through said housing into such an oven.

3. A solvent vapour collector as claimed in claim 1 and in which said co-operating guide means comprise tracks with rollers movable therealong.

4. A solvent vapour collector as claimed in claim 1 and in which said shroud comprises a plurality of generally tubular elongated members mutually telescopic and extensible from and retractable into said housing.

5. A solvent vapour collector as claimed in claim 4 and in which an upstream one of said generally tubular elongated members is formed at its upstream end with an open undersurface for overlying a coating station whereby solvent fumes from such a coating station may be inducted into such a generally tubular elongated member for passage through said shroud and said housing into such an oven.

6. A solvent vapour collector as claimed in claim 5 and in which said air induction means comprise an upper plenum and a lower plenum adapted to receive hot gases from said oven and to discharge such gases through openings therein against the top and under surfaces respectively of a strip sheet passing from such a coating station, through said oven extension and to said curing oven so to induct downstream gas flows along the top and under surfaces of such a strip sheet.

7. A solvent vapour collector as claimed in claim 6 and in which said openings in said upper plenum and said lower plenum are disposed so as to discharge gases against such a strip sheet passing therebetween in an oblique direction thereby to induct such downstream gas flows along the top and under surfaces of such a strip sheet and in turn the entry of solvent vapours into said upstream one of said generally tubular elongated members.

8. In combination:

a coating station adapted to apply a coating containing a vaporizable solvent to a strip sheet passing therethrough;

an oven spaced apart from said coating station in a downstream direction with respect to the direction of movement of such a strip passing from said coating station to said oven and adapted to evaporate such solvent from such strip sheet; and a solvent vapour collector between said coating station and said oven for the passage therethrough of such a strip sheet, and which additionally comprises:

a housing forming part of said solvent vapour collector and in turn comprising a base, a roof, side walls and an upstream end wall and secured about its downstream end to an upstream inlet end of said oven;

elongated shroud means forming part of said solvent vapour collector and movably mounted on said upstream end wall of said housing for movement between a retracted position in which said shroud is disposed at least partially within said housing and an extended position in which said shroud projects from said housing toward said coating station, said shroud including a roof terminating in a free end, extending over said coating station and side walls and a bottom wall terminating in a free end, said bottom wall being shorter than said roof whereby said free ends of said roof and said bottom wall form an opening directed downwardly towards said coating station for the passage into said shroud of both a coated strip sheet and ambient air and solvent vapours from said strip, and from around said coating station when said shroud is in said extended position thereof with said roof overlying said strip and said coating station to entrap solvent vapours, without contacting said coating station;

air induction means in said housing for inducting ambient air and solvent vapours entrained therewith through said shroud into said oven, thereby enabling said solvent vapours to be treated within said oven, and, co-operating guide means on said housing and said shroud permitting movement of said shroud between said retracted and extended positions thereof.

9. A combination as claimed in claim 8 and in which said co-operating guide means comprise tracks with rollers movable therealong.

10. A combination as claimed in claim 8 and in which said shroud comprises a plurality of generally tubular elongated members mutually telescopic and extensible from and retractable into said housing.

11. A combination as claimed in claim 10 and in which an upstream one of said generally tubular elongated members is formed at its upstream end with said opening, and said roof overlying said coating station when said shroud is in said extended position thereof whereby solvent fumes from said coating station may be inducted into said generally tubular elongated member for passage through said shroud and said housing and into said oven.

12. A combination as claimed in claim 11 and in which within said housing there are provided an upper plenum and a lower plenum adapted to receive gases from said oven and to discharge such gases through openings therein against the top and under surfaces respectively of a strip sheet passing from said coating station, through said solvent vapour collector and into said oven to induct downstream gas flows along top and under surfaces of such a strip sheet.

13. A combination as claimed in claim 12 and in which said openings in said upper plenum and said lower plenum are disposed so as to discharge gases against such a strip sheet passing therebetween in an oblique direction thereby to induct such downstream gas flows along the top and under surfaces of such a strip sheet.

14. A combination as claimed in claim 8 and which additionally comprises auxiliary heating means within said shroud.

* * * * *